US006781565B2

(12) United States Patent
Ozawa

(10) Patent No.: US 6,781,565 B2
(45) Date of Patent: Aug. 24, 2004

(54) ELECTRO-OPTICAL DEVICE, DRIVING CIRCUIT AND DRIVING METHOD OF ELECTRO-OPTICAL DEVICE, AND ELECTRONIC APPARATUS

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 374 days.

(21) Appl. No.: 09/742,184

(22) Filed: Dec. 22, 2000

(65) Prior Publication Data

US 2001/0017610 A1 Aug. 30, 2001

(30) Foreign Application Priority Data

Dec. 28, 1999 (JP) ..... 11-375304

(51) Int. Cl.[7] ..... G09G 3/34
(52) U.S. Cl. ..... 345/84; 345/85
(58) Field of Search ..... 345/84, 85, 87, 345/86, 76, 77, 80, 92, 98–100, 204–213; 315/169.1; 359/645

(56) References Cited

U.S. PATENT DOCUMENTS 5,194,974 A 3/1993 Hamada et al.
5,587,329 A 12/1996 Hseuh et al.
6,049,321 A * 4/2000 Sasaki ..... 345/99
6,278,423 B1 * 8/2001 Wald et al. ..... 345/76
6,295,054 B1 * 9/2001 McKnight ..... 345/205
6,307,681 B1 * 10/2001 Aoki et al. ..... 359/645
6,388,646 B1 * 5/2002 Fujiwara et al. ..... 345/87
6,426,594 B1 * 7/2002 Ito ..... 315/169.1
6,452,589 B1 * 9/2002 McKnight ..... 345/205
6,498,596 B1 * 12/2002 Nakamura et al. ..... 345/98
6,521,912 B1 * 2/2003 Sakama et al. ..... 257/57

FOREIGN PATENT DOCUMENTS

JP A-4-70897 3/1992
JP A-4-177321 6/1992

* cited by examiner

*Primary Examiner*—Amare Mengistu
*Assistant Examiner*—Prabodh M. Dharia
(74) *Attorney, Agent, or Firm*—Oliff & Berridge, PLC

(57) ABSTRACT

Lamp wave signals are supplied to signal supply lines via switches. The switches are turned ON when their corresponding scanning lines are selected. Hence, a load on the driving circuit for the lamp wave signals will be a parasitic capacitance that comes from a single signal supply line. PWM signals of having pulse widths based on image data are supplied to data lines. A TFT supplies PWM signals to a gate electrode of a TFT when a corresponding scanning line is selected; therefore, the lamp wave signal is applied to a pixel electrode via the TFT when the data line and the scanning line simultaneously become active.

13 Claims, 10 Drawing Sheets

[FIG. 1]
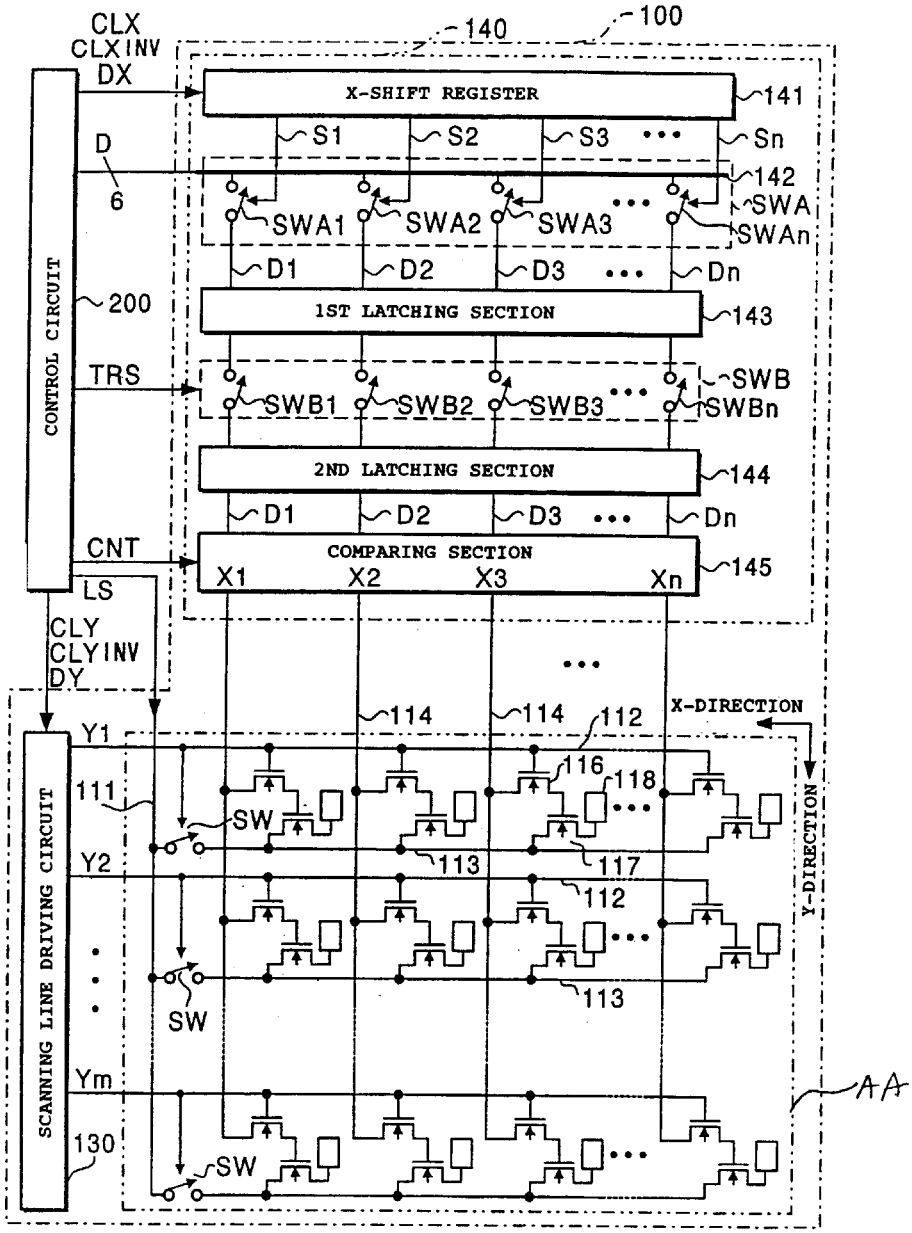

[FIG. 2]
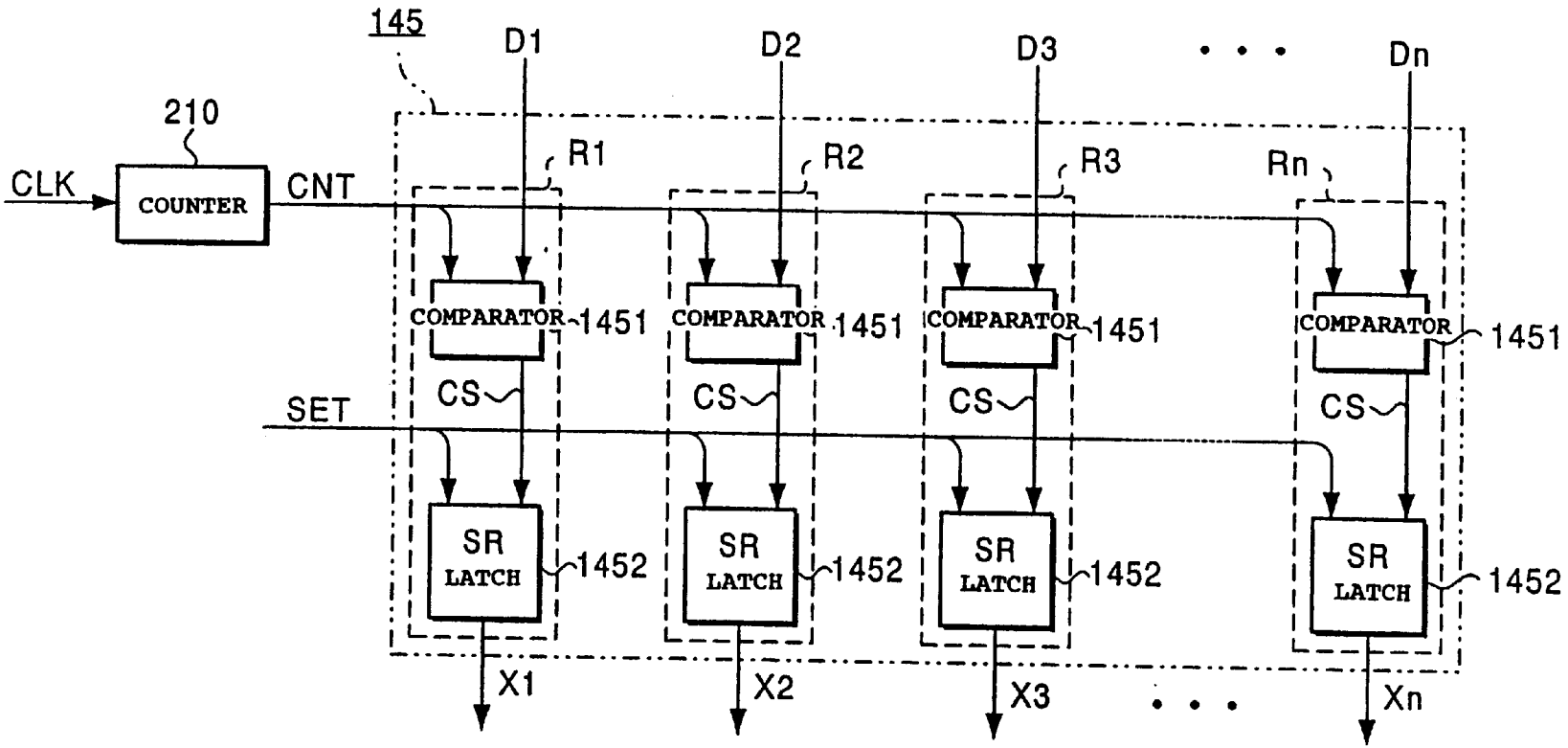

[FIG. 3]
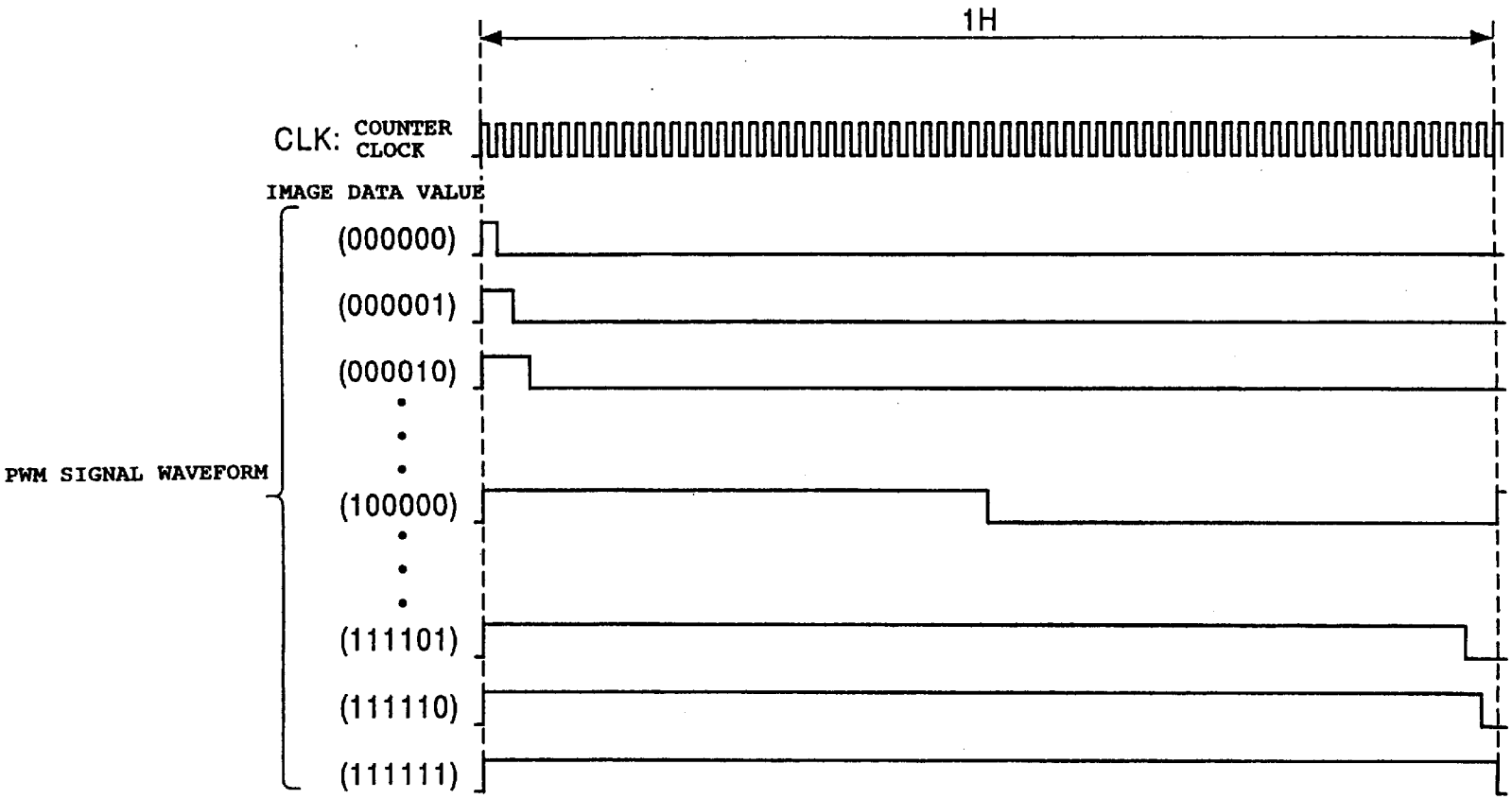

[FIG. 4]
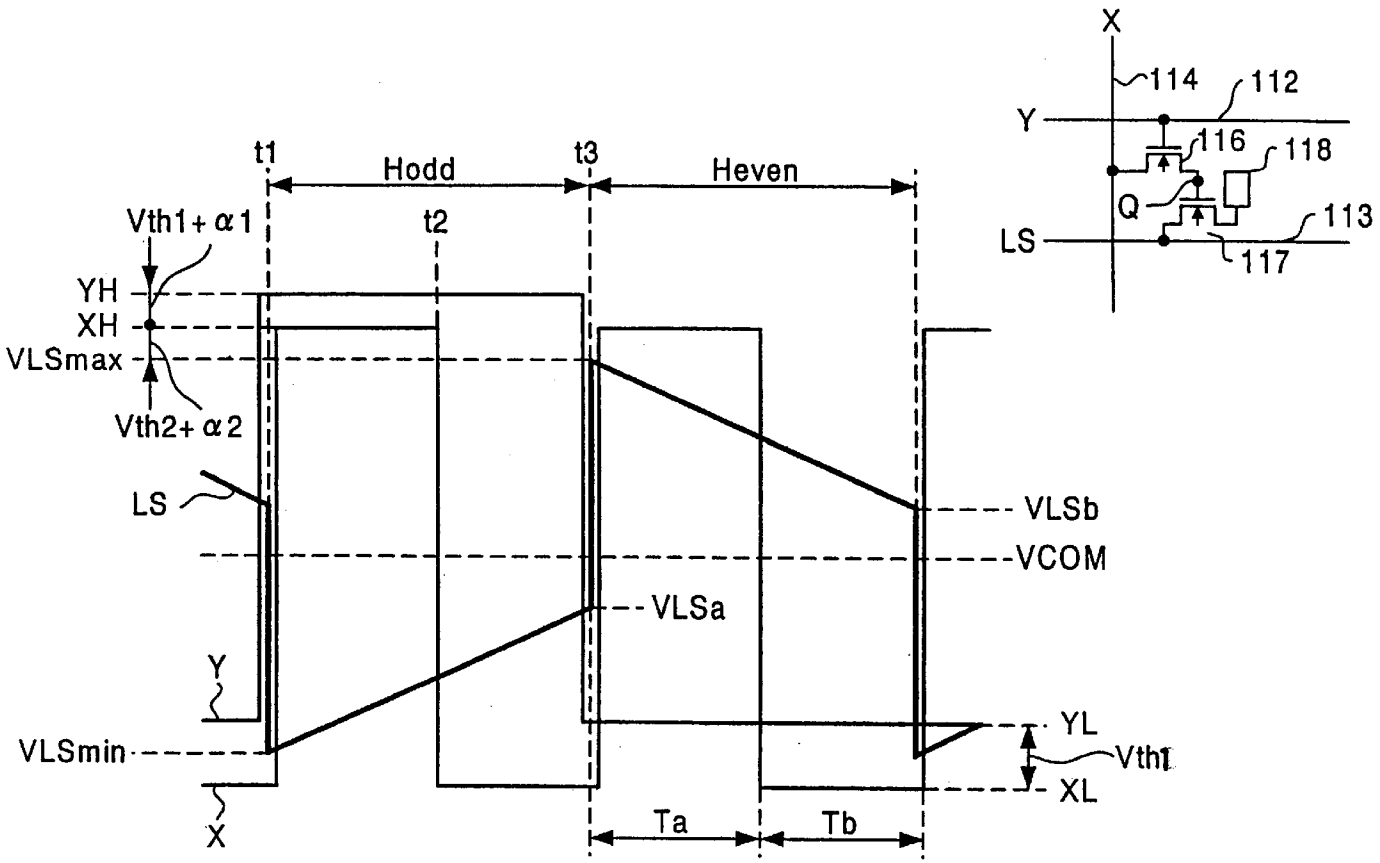

[FIG. 5]
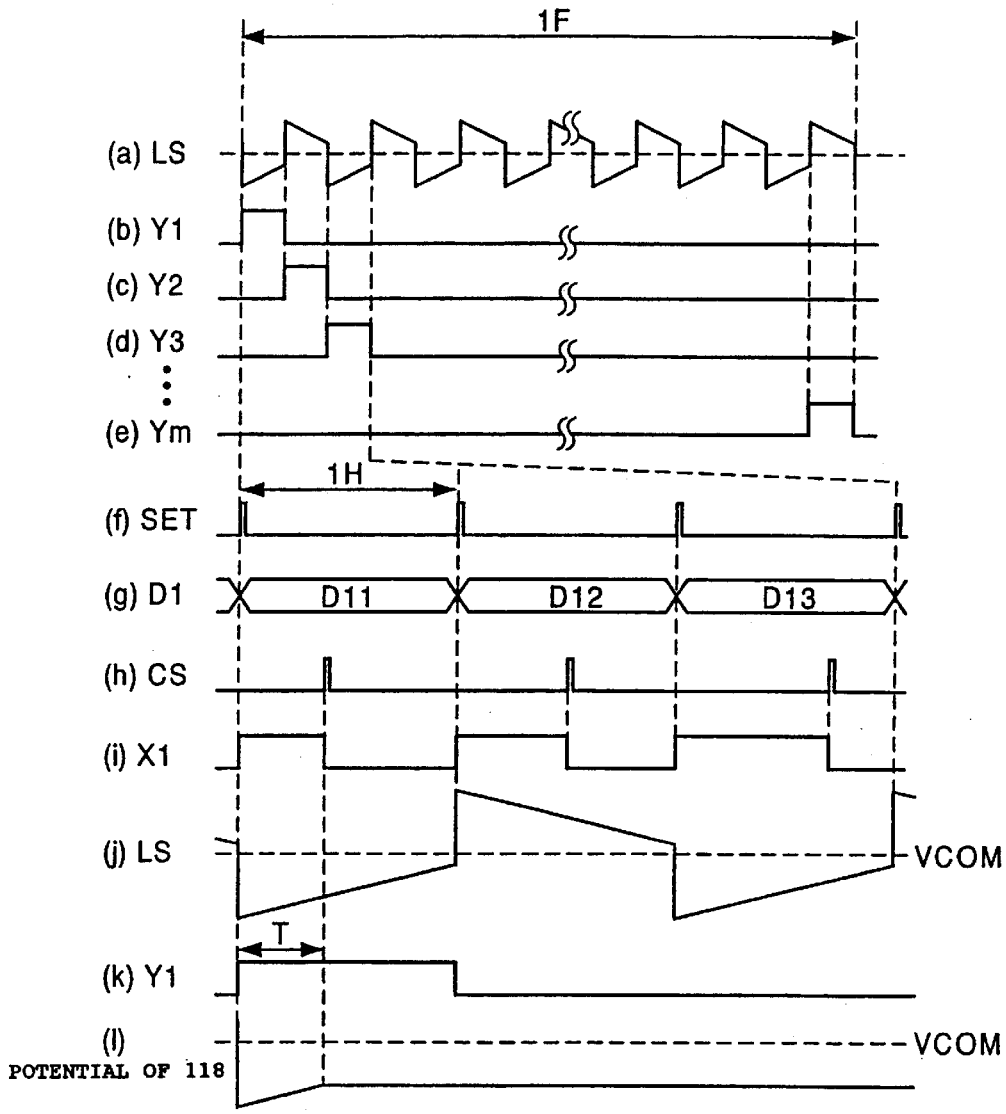

[FIG. 6]
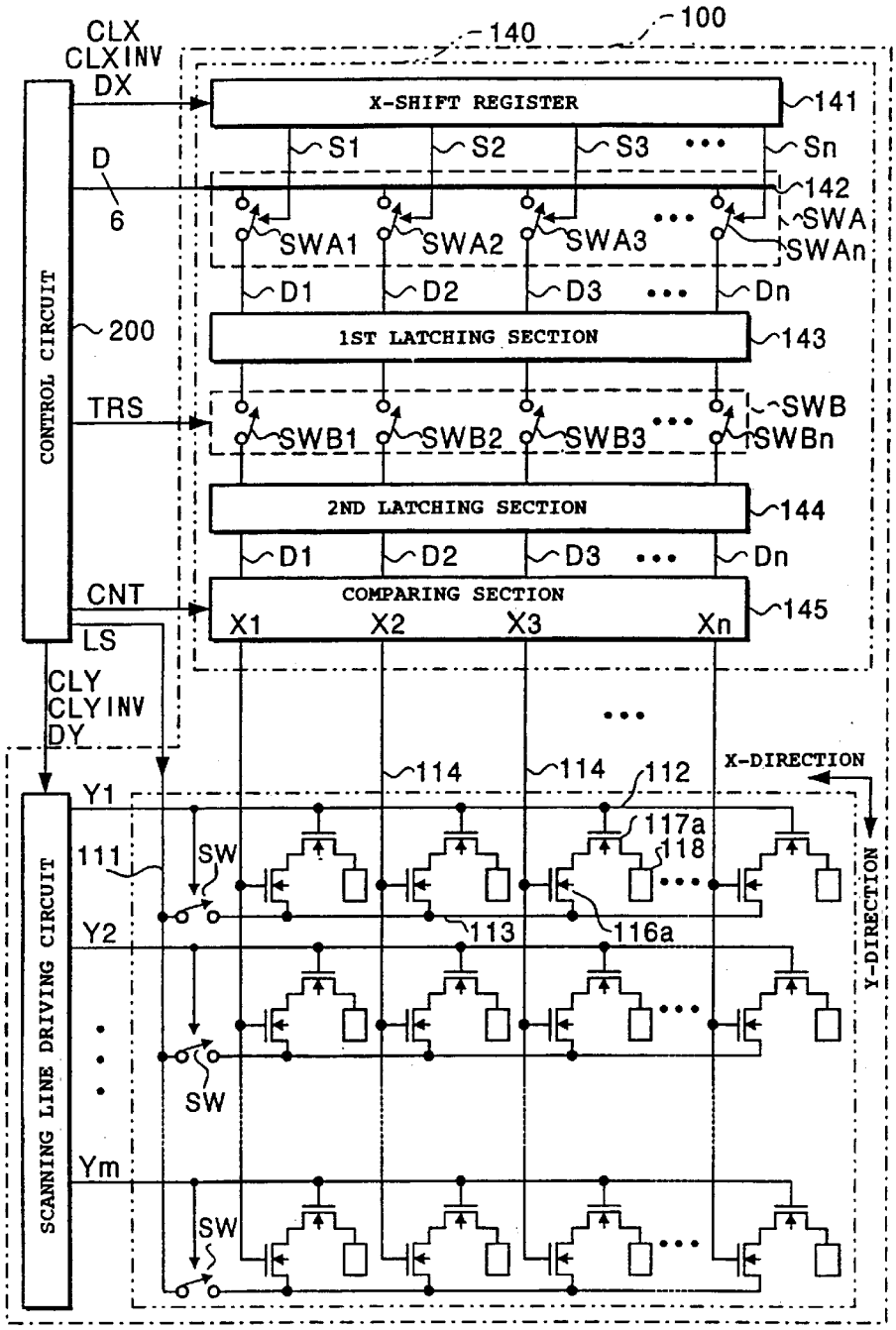

[FIG. 7]
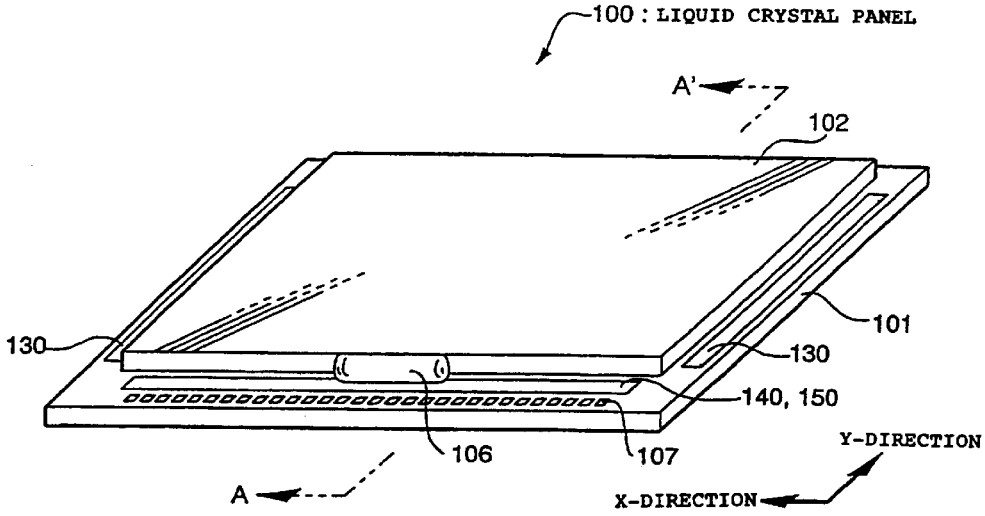
[FIG. 8]
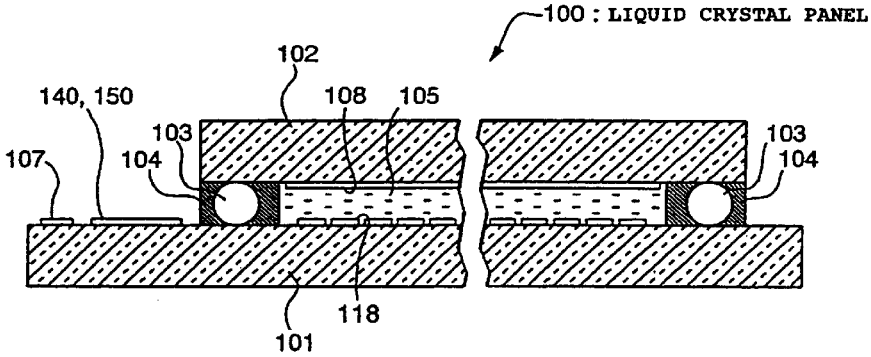

[FIG.9]
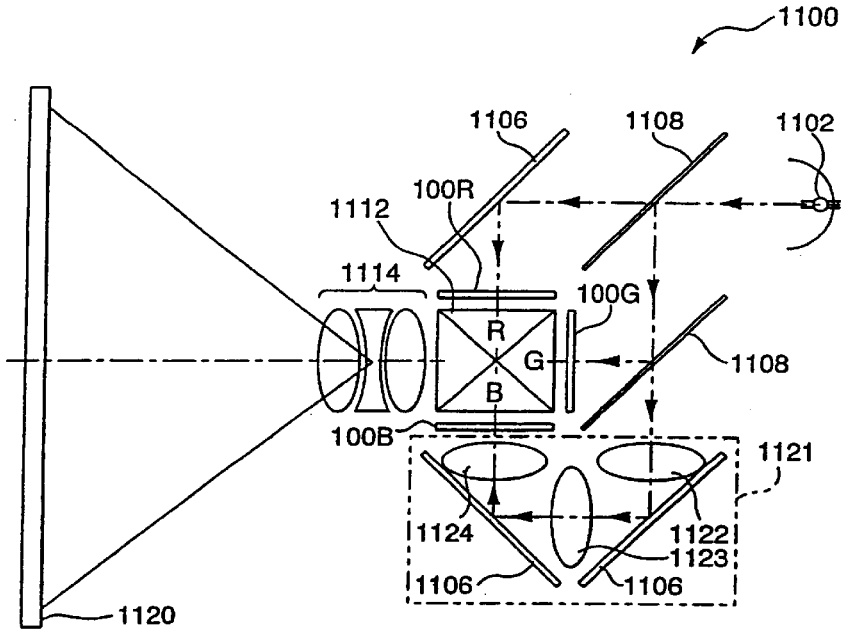
[FIG. 10]
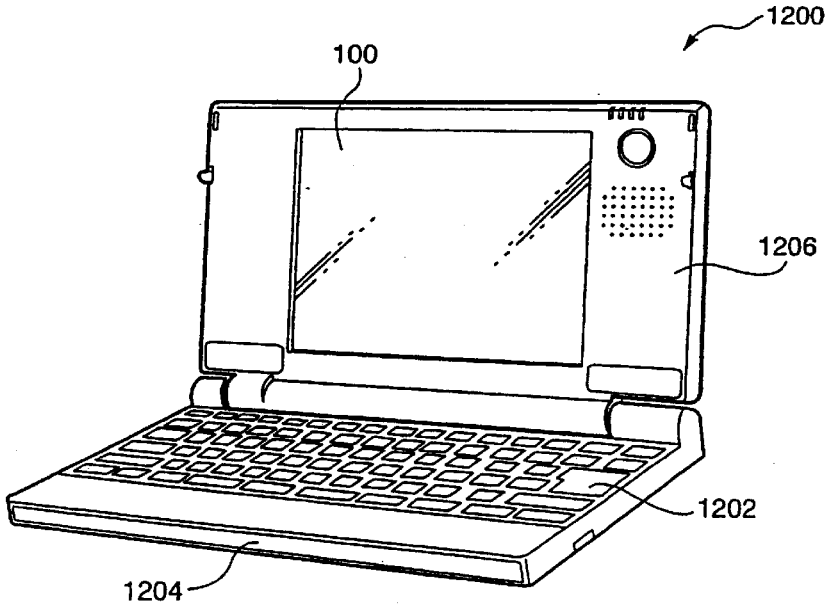

[FIG. 11]
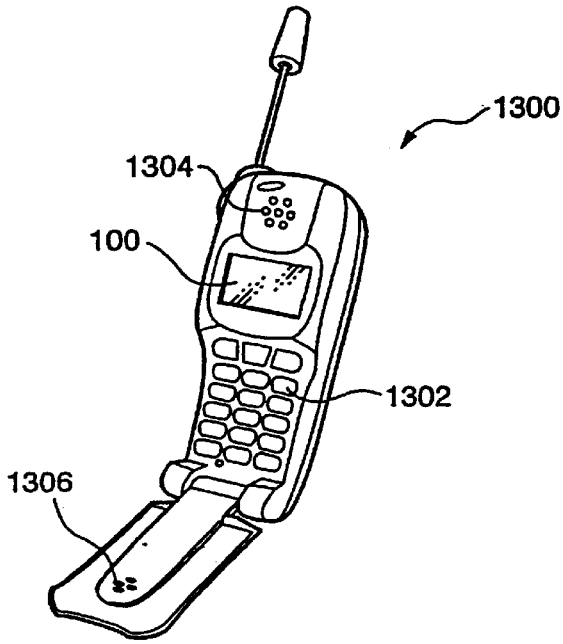

[FIG. 12]
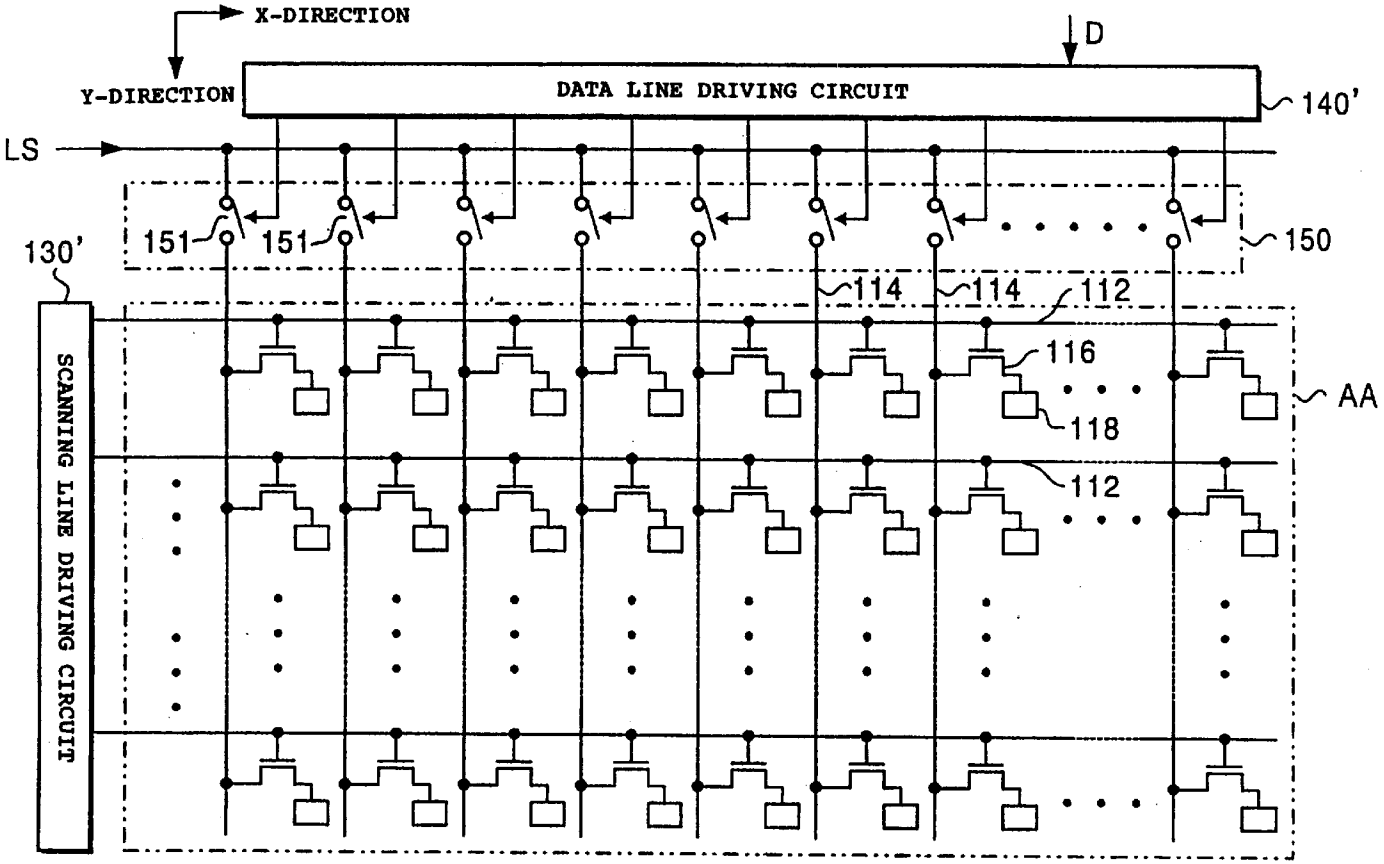

ELECTRO-OPTICAL DEVICE, DRIVING CIRCUIT AND DRIVING METHOD OF ELECTRO-OPTICAL DEVICE, AND ELECTRONIC APPARATUS

BACKGROUND OF THE INVENTION

1. Field of Invention

The present invention relates to an electro-optical device featuring reduced power consumption, a driving circuit and a driving method of the electro-optical device, and an electronic apparatus employing the electro-optical device as a display unit.

2. Description of the Related Art

A driving circuit of a conventional electro-optical device, such as a liquid crystal device, is constituted by a data line driving circuit, a scanning line driving circuit, etc. for supplying image signals, scanning signals, etc. at predetermined timings to data lines, scanning lines, etc. disposed in an image display region.

The data line driving circuit significantly differs in configuration, depending on whether input image signals are analog signals or digital signals. However, when display in a plurality of gray scales is performed, it is necessary to apply a voltage of an analog signal to a liquid crystal regardless of the type of an input image signal. Hence, if the input image signal is a digital signal, then the input image signal must be subjected to DA conversion so as to apply an analog signal voltage to the liquid crystal.

As a technique for the DA conversion, the PWM (Pulse Width Modulation) method is known. FIG. 12 is a block diagram showing a configuration of a liquid crystal device to which the PWM method has been applied. As shown in FIG. 12, a liquid crystal device may be constructed by a data line driving circuit 130', a scanning line driving circuit 140', a group of switches 150, and an image display region AA.

In the image display region AA, a plurality of scanning lines 112 are formed so that they are arranged in parallel in an X-direction, and a plurality of data lines 114 are formed in parallel in a Y-direction perpendicular thereto. Furthermore, at intersections of these scanning lines 112 and the data lines 114, thin film transistors (hereinafter referred to as "TFTs") serving as switches for controlling pixels are provided.

In this example, a gate electrode of a TFT 116 is connected to the scanning lines 112, a source electrode of the TFT 116 is connected to the data lines 114, and a drain electrode of the TFT 116 is connected to a pixel electrode 118. Each of the pixels is constructed by the pixel electrode 118, a common electrode formed on an opposing substrate, and a liquid crystal sandwiched between the two electrodes; hence, the pixels are arranged in a matrix pattern in association with the intersections of the scanning lines 112 and the data lines 114. The data lines 114 oppose the common electrodes via the liquid crystal, and intersect with the scanning lines 112, so that each data line 114 is accompanied with a parasitic capacitance.

The data line driving circuit 140' line-sequentially outputs selected signals corresponding to the data lines 114, based on input image data D. The period during which the selected signals are set active is decided based on input image data values to be displayed at pixels corresponding to the selected signals. Lamp wave signals LS are supplied to input terminals of switches 151 making up the group of switches 150, and output terminals thereof are connected to data lines 114, selected signals being supplied to control terminals thereof. The switches 151 are configured so that they stay ON during a period in which selected signals stay active. Hence, the lamp wave signals LS are supplied to the data lines 114 only during a period corresponding to input image data values to be displayed at pixels. As a result, the lamp wave signals are written to the parasitic capacitors of the data lines 114 only during a period corresponding to input image data values. Furthermore, the scanning line driving circuit 130' generates scanning signals that become active for each horizontal scanning period and output the scanning signals to the scanning lines 112.

In the configuration described above, if a certain scanning line 112 is selected by a scanning signal, then the TFT 116 connected to that scanning line 112 turns ON in the horizontal scanning period. At this time, the lamp wave signal LS is written to the parasitic capacitor of the data line 114 only for the period corresponding an input image data value; hence, a voltage based on the input image data value is applied to the pixel electrode 118, and the applied voltage is held when the TFT 116 turns OFF. This makes it possible to display a gray scale based on a gray scale value indicated by input image data.

In the liquid crystal device set forth above, the lamp wave signals LS are written to the parasitic capacitors of the data lines 114, and the voltages of the parasitic capacitors are captured into the pixels via the TFTs 116. Therefore, the driving circuit for the lamp wave signals LS is required to have a sufficient driving capability for writing to the parasitic capacitors.

SUMMARY OF THE INVENTION

In the configuration of FIG. 12, even when the image display region AA is relatively small, a parasitic capacitance value of each of the data lines 114 is approximately 20 pF. In a liquid crystal device of a so-called XGA (1024 pixels× 768 pixels) type, 1024 data lines are provided for each color of R, G, and B, so that a total parasitic capacitance value of the data lines 114 will be approximately 61 nF. If input image data includes 6 bits, then charging must be completed in a 1/64 H period for the capacitance of 61 nF. This means that it is necessary to use a driving circuit capable of driving a heavy load for the driving circuit of the lamp wave signals LS, presenting a problem of an increased circuit scale. Furthermore, there has been a problem in that the driving circuit consumes more power to drive a heavier load.

The present invention has been accomplished at least in view of the above, and it is an object of the present invention to at least provide an electro-optical device featuring a reduced drive load, a driving circuit thereof, and an electronic apparatus employing the electro-optical device as its display unit.

A driving method for an electro-optical device in accordance with one exemplary embodiment of the present invention is intended for driving an electro-optical device equipped with a plurality of data lines, a plurality of scanning lines, pixel electrodes corresponding to intersections of the scanning lines and the data lines, and a plurality of signal supply lines corresponding to the scanning lines. The driving method may consist of the steps of: supplying scanning signals for sequentially selecting the scanning lines; sequentially supplying reference signals to the signal supply lines synchronously when the scanning signals become active; supplying pulse width modulation signals that are active only during a period corresponding to a gray scale value indicated by image data to the data lines; and capturing the reference signals from the signal supply lines corresponding to pixels and applying them to the pixel electrodes during a period in which the scanning lines and the data lines corresponding to the pixels simultaneously become active at the pixels corresponding to the intersections of the scanning lines and the data lines, while holding voltages of the pixel electrodes during a period in which either the scanning lines or the data lines corresponding to the pixels become inactive.

According to this exemplary embodiment, as soon as scanning signals are set active, the reference signals are sequentially supplied to the signal supply lines. Hence, a load on the driving circuit that drives the reference signals will be a parasitic capacitance on a single signal supply line, so that the load can be reduced. As a result, in the step for supplying reference signals, current consumption can be considerably reduced.

Furthermore, the electro-optical device in accordance with another exemplary embodiment the present invention is assumed to have an electro-optical material sandwiched between a pair of substrates. The electro-optical device may consist of, on one of the substrates: a plurality of data lines; a plurality of scanning lines; a plurality of pixel electrodes provided in association with intersections of the scanning lines and the data lines; a plurality of signal supply lines corresponding to the scanning lines; a signal supply circuit for selecting one of the signal supply lines that has its corresponding scanning line in an active state, and supplying a reference signal to the selected signal supply line; and voltage holding circuits that are provided for the intersections of the scanning lines and the data lines, and capture the reference signals from the signal supply lines corresponding to pixels and apply them to the pixel electrodes during a period in which the scanning lines and the data lines corresponding to the pixels simultaneously become active, while they hold voltages of the pixel electrodes during a period in which one of corresponding scanning lines or data lines become inactive.

According to this exemplary embodiment, the signal supply circuit selects one having its corresponding scanning line set active from among the signal supply lines, and supplies a reference signal to the selected signal supply line. The scanning lines are adapted to be sequentially selected. Therefore, the reference signal is supplied to only one signal supply line. Thus, a load on the driving circuit for driving reference signals will be a parasitic capacitance on the single signal supply line, permitting a significant reduction in load. Moreover, the circuit configuration of the driving circuit can be made simpler, and current consumption in the driving circuit can be also considerably reduced.

Preferably, the signal supply circuit includes: a switching element provided for each of the signal supply lines, one end of the signal supply line being connected to one terminal thereof, and turning ON/OFF thereof being controlled by a signal of an corresponding scanning line; and a common signal line which is connected to the other terminal of each switching element and to which the reference signal is supplied. In this invention, the switching elements can be turned ON/OFF by the signals of the scanning lines; hence, the reference signal can be supplied only to the signal supply line corresponding to the scanning line to be selected.

Furthermore, each of the voltage holding circuits preferably includes: a first transistor element provided for each of the intersections of the scanning lines and the data lines, the first transistor having a gate electrode connected to the scanning line, and a source electrode connected to the data line; and a second transistor element provided for each of the intersections of the scanning lines and the data lines. A drain electrode of the first transistor element is connected to a gate electrode of the second transistor element. A source electrode of the second transistor element is connected to the signal supply line. A drain electrode of the second transistor element is connected to the pixel electrode.

In this exemplary embodiment, the first transistor element and the second transistor element are controlled by voltages of gate lines and the scanning lines, and the voltages of the signal supply lines are applied to pixel electrodes when the first and second transistor elements simultaneously turn ON. The reference signals are supplied to the signal supply lines when corresponding scanning lines are selected; therefore, when the first and second transistor elements simultaneously turn ON, the reference signals are applied to the pixel electrodes. With this arrangement, gray scale display based on a gray scale value of image data can be accomplished. In addition, since the data lines are connected to the source electrodes of the first transistor elements, the values of the parasitic capacitance on the data lines can be reduced. With this arrangement, the load on the driving circuit that drives the data lines can be reduced, and current consumption can be reduced.

Furthermore, each of the voltage holding circuits may include: a first transistor element provided for each of the intersections of the scanning lines and the data lines, the first transistor element having a gate electrode connected to the data line and a source electrode connected to the signal supply line; and a second transistor element provided for each of the intersections of the scanning lines and the data lines A drain electrode of the first transistor element is connected to a source electrode of the second transistor element. A gate electrode of the second transistor element is connected to the scanning line. A drain electrode of the second transistor element is connected to the pixel electrode.

In this exemplary embodiment, when the first and second transistor elements simultaneously turn ON, the voltages of the signal supply lines are applied to the pixel electrodes. The reference signals are supplied to the signal supply lines when corresponding scanning lines are selected, so that the reference signals are applied to the pixel electrodes when the first and second transistor elements simultaneously turn ON. This arrangement makes it possible to accomplish gray scale display based on a gray scale value of image data.

A driving circuit of the electro-optical device in accordance with another exemplary embodiment of the present invention may consist of: a reference signal generating circuit for generating the reference signals; a converting circuit for converting image data into line-sequential data; a pulse width modulating circuit for generating pulse width modulation signals in which pulse widths have been modulated based on data values of the line-sequential data, and outputting the pulse width modulation signals to the data lines; and a scanning line driving circuit for generating scanning signals for sequentially setting the scanning lines active, and outputting the scanning signals to the scanning lines. According to this exemplary embodiment, the reference signals are generated while line-sequentially supplying the pulse width modulation signals to the data lines and also generating scanning signals, allowing gray scale display to be accomplished by driving the electro-optical device.

Furthermore, in a driving circuit of an electro-optical device in accordance with another exemplary embodiment of the present invention, the electro-optical device is assumed to be provided with: a first transistor element that is provided for each of the intersections of the scanning lines and the data lines, the first transistor element having a gate electrode connected to the scanning line and a source electrode connected to the data line; and a second transistor element provided for each of the intersections of the scanning lines and the data lines. A drain electrode of the first transistor element is connected to a gate electrode of the second transistor element. A source electrode of the second transistor element is connected to the signal supply line. A drain electrode of the second transistor element is connected to the pixel electrode. The driving circuit may consist of: a reference signal generating circuit for generating the reference signals; a converting circuit for converting image data into line-sequential data; a pulse width modulating circuit for generating pulse width modulation signals in which pulse widths have been modulated based on data values of the line-sequential data, and outputting the pulse width modulation signals to the data lines; and a scanning line driving circuit for generating scanning signals for sequentially setting the scanning lines active, and outputting the scanning signals to the scanning lines. A low-level potential of the scanning signals is set to be higher than a low-level potential of the pulse width modulation signal by about a threshold value voltage of the second transistor.

According to this exemplary embodiment, the low-level potential of the scanning signals is set to be higher than the low-level potential of the pulse width modulation signals by about the threshold voltage of the second transistor. Hence, in a non-selection period of scanning lines, the first transistor elements corresponding to the scanning lines can be operated at a boundary between an ON state and an OFF state, making it possible to avoid a floating state of the gate electrode of the second transistor element. Therefore, the second transistor element can be securely turned OFF in the non-selection period of scanning lines.

In addition, in the driving circuit of the electro-optical device, preferably, the pulse width modulating circuit generates a pulse width modulation signal so that a high-level potential of the pulse width modulation signal is higher than a maximum potential of the reference signal by at least the threshold value voltage of the second transistor element, and the scanning line driving circuit generates the scanning signal so that a high-level potential of the scanning signal is higher than the high-level potential of the pulse width modulation signal by at least a threshold value voltage of the first transistor element. According to this exemplary embodiment, when the pulse width modulation signal is high-level, the first transistor element and the second transistor element can be securely turned ON to apply the reference signals to the pixel electrodes.

Furthermore, the reference signals are preferably lamp wave signals. However, when gamma correction is performed by using the reference signals, reference signals following a gamma correction curve may be used.

Furthermore, the driving circuit described above may be formed on one of the two substrates of the electro-optical device. In this case, the transistor elements making up the driving circuit may be fabricated using the same manufacturing process for the first and second transistor elements thereby to reduce manufacturing cost.

In addition, an electronic device in accordance with various exemplary embodiments of the present invention may consist of the foregoing electro-optical device, so that power consumption can be reduced.

BRIEF DESCRIPTION OF THE DRAWINGS

FIG. 1 is a block diagram showing a general configuration of a liquid crystal device according to a first exemplary embodiment of the present invention;

FIG. 2 is a block diagram showing a configuration of a comparing section in the liquid crystal device;

FIG. 3 is a timing chart showing values of image data and waveforms of PWM signals;

FIG. 4 presents diagrams showing a peripheral circuit of one pixel and voltage levels of various signals;

FIG. 5 is a timing chart for explaining an operation of the liquid crystal device;

FIG. 6 is a block diagram showing a general configuration of a liquid crystal device according to a second exemplary embodiment of the present invention;

FIG. 7 is a perspective view showing a structure of a liquid crystal panel;

FIG. 8 is a partial sectional view for explaining the structure of the liquid crystal panel;

FIG. 9 is a sectional view showing a configuration of a projector, which is an example of electronic equipment to which the liquid crystal device has been applied;

FIG. 10 is a perspective view showing a configuration of a personal computer, which is another example of electronic equipment to which the liquid crystal device has been applied;

FIG. 11 is a perspective view showing a configuration of a portable telephone, which is still another example of electronic equipment to which the liquid crystal device has been applied; and FIG. 12 is a block diagram showing a general configuration of a conventional liquid crystal device.

DETAILED DESCRIPTION OF PREFERRED EMBODIMENTS

Exemplary embodiments of the present invention will now be described with reference to the accompanying drawings.

First Embodiment

First, an electro-optical device according to a first exemplary embodiment of the present invention will be described, taking a liquid crystal device employing a liquid crystal as an electro-optical material as an example.

General Configuration of the Liquid Crystal Device

FIG. 1 is a block diagram showing an electrical configuration of the liquid crystal device. As shown in the drawing, the liquid crystal device may include a liquid crystal panel 100 and a control circuit 200. Of these components, the control circuit 200 outputs timing signals, control signals, etc. (which will be discussed later when necessary) that are used at individual sections.

The liquid crystal panel 100 is constructed by an element substrate and an opposing substrate attached to each other so that their surfaces with electrodes formed thereon face each other, as it will be discussed hereinafter. On the element substrate, a scanning line driving circuit 130, a data line driving circuit 140, and an image display region AA are formed. The following will describe the configurations of these components.

Configuration of the Image Display Region

An electrical configuration of the image display region AA will now be described. As shown in FIG. 1, on the element substrate, a plural number (m) of scanning lines 112 are formed so that they are arranged in parallel in an X-direction in FIG. 1, and a plural number (m) of signal supply lines 113 are formed and arranged to correspond to the scanning lines 112. Furthermore, a plural number (n) of data lines 114 are formed in parallel in a Y-direction perpendicular thereto. Each pixel is constructed by a pixel electrode 118, a common electrode (which will be discussed later) formed on the opposing substrate, and a liquid crystal sandwiched between these two electrodes. The pixels are arranged in a matrix pattern, corresponding to the intersections of the scanning lines 112 and the data lines 114. As an alternative configuration, storing capacitors (not shown), one for each pixel, may be formed in parallel to the liquid crystal sandwiched between the pixel electrodes 118 and the common electrodes, as electrically observed.

At each intersection of the scanning line 112 and the data line 114, switches TFT 116 and TFT 117 serving as switches for controlling the pixels are provided. A gate electrode of the TFT 116 is connected to the scanning line 112, a source electrode of the TFT 116 is connected to the data line 114, and a drain electrode of the TFT 116 is connected to a gate electrode of the TFT 117. A source electrode of the TFT 117 is connected to the signal supply line 113, and a drain electrode thereof is connected to the pixel electrode 118. Therefore, when the TFT 116 and the TFT 117 simultaneously turn ON, a voltage of the signal supply line 113 is applied to the pixel electrode 118.

In addition, one end of each signal supply line 113 is connected to a common signal line 111 via each switch SW. A lamp wave signal LS of a 2 H cycle is supplied from the control circuit 200 to the common signal line 111. Each switch SW is controlled by a voltage of the corresponding scanning line 112, and turned ON in a period during which scanning signals Y1 to Ym of the scanning lines 112 become active.

The scanning signals Y1 to Ym are the signals that sequentially become active for each horizontal scanning period. Hence, of all switches SW, no more than one of them is turned ON at any time, so that the driving circuit of the lamp wave signal LS is connected to a single signal supply line 113. As a result, the load on the driving circuit of the lamp wave signal LS mainly comes from the parasitic capacitance of the single signal supply line 113. In other words, according to the configuration set forth above, the load will be the parasitic capacitance that comes from a single signal supply line 113 extending in the X-direction rather than the parasitic capacitances of all the data lines 114 extending in the Y-direction as in the prior art. Thus, the load on the driving circuit can be dramatically reduced.

The scanning line driving circuit 130 and the data line driving circuit 140 are on the opposing surface of the element substrate composed of glass or the like having transparency and nonconductivity, and are formed in a peripheral portion of the image display region AA, as it will be discussed hereinafter. The scanning line driving circuit 130 and the data line driving circuit 140 are formed of combinations of p-channel TFTs and n-channel TFTs, which are formed in the same manufacturing process as the TFTs 116 and 117 for driving the pixels, thus achieving higher manufacturing efficiency, reduced manufacturing cost, and uniformity of element characteristics, etc.

Configuration of the Data Line Driving Circuit

The data line driving circuit 140 according to the embodiment will now be described. The data line driving circuit 140 is constructed by an X-shift register 141, an image data supply line 142, groups of switches SWA and SWB, a first latching section 143, a second latching section 144, and a comparing section 145.

First, the X-shift register 141 is adapted to sequentially shift a transfer start pulse DX supplied at the beginning of the horizontal scanning period according to a clock signal CLX and its inverted clock signal CLXINV thereby to output sampling signals S1 to Sn in a predetermined sequence.

The image data supply line 142 is adapted to supply image data in a parallel mode. If image data D has j bits per sample, then the image data supply line 142 is formed of j number of wires. In this example, the image data D has 6 bits per sample, so that the image data supply line 142 is formed of six wires. If, however, image data is, for example, "color" image data, then the number of the image data supply lines 142 will be 18 (=6 (bit width)×3 (R/G/B)).

The group of switches SWA is constructed by n switches SWA1 to SWAn. Input and output terminals of each switch of SWA1 to SWAn are connected to the image data supply line 142 and the first latching section 143, and the sampling signals S1 to Sn are supplied to control terminals of the switches SWA1 to SWAn. One switch is adapted to control whether to supply 6-bit image data to the first latching section 143 by one sampling signal. The switches SWA1 to SWAn turn ON when the sampling signals S1 to Sn are active, while they turn OFF when the sampling signals are inactive.

The first latching section 143 is composed of n latching circuits to latch image data D1 to Dn supplied from the group of switches SWA. With this arrangement, the image data D can be converted into dot-sequential data.

The group of switches SWB is constructed by n switches SWB1 to SWBn. Input and output terminals of each switch of SWB1 to SWBn are connected to the first latching section 143 and the second latching section 144, and a transfer signal TRS is supplied to control terminals of the switches SWB1 to SWBn. The switches SWB1 to SWBn turn ON when the transfer signal TRS is active, while they turn OFF when the transfer signal TRS is inactive. The transfer signal TRS is a signal that becomes active upon completion of the horizontal scanning period.

The second latching section 144 is composed of n latching circuits to latch image data D1 to Dn supplied from the group of switches SWB. As mentioned above, the transfer signal TRS becomes active upon completion of the horizontal scanning period; hence, all output signals of the second latching section 144 will be line-sequential data that has been converted from the image data D. In other words, the X-shift register 141, the image data supply line 142, the groups of switches SWA and SWB, the first latching section 143, and the second latching section 144 function as means (a converting circuit) for converting the image data D into the line-sequential data.

The comparing section 145 will now be described. FIG. 2 is a block diagram showing the comparing section 145 and a configuration of its peripheral circuit. As shown in the drawing, the comparing section 145 is formed of n unit circuits R1 to Rn. Each of the unit circuits R1 to Rn is equipped with a comparator 1451 and an SR latch 1452. The control unit 200 is provided with a counter 210. The counter 210 counts counter clock signals CLK from the start of the horizontal scanning period, generates count data CNT indicating a count result, and outputs the count data CNT to the comparing section 145. In addition, the control unit 200 outputs a set signal SET, which is set to an H level at the start of the horizontal scanning period, to the comparing section 145.

In each of the unit circuits R1 to Rn, the comparator 1451 compares the image data D1 to Dn with the count data CNT, and supplies a comparison signal CS to a reset terminal of the SR latch 1452, the comparison signal CS being set to the H level when the image data and the count data coincide, while it is set to the L level when they do not coincide. The SR latch 1452 of each of the unit circuits RI to Rn shifts its logical level to the H level when a set signal SET supplied to a set terminal goes to the H level. Thereafter, when the comparison signal CS goes to the H level, the SR latch 1452 shifts its logical level to the L level, and generates PWM signals (pulse width modulation signals) X1 to Xn.

FIG. 3 is a timing chart illustrating values of image data and waveforms of PWM signals. As shown in the chart, H-level periods of the PWM signals are based on gray scale values indicated by image data.

The PWM signals X1 to Xn obtained as described above are supplied as output signals of the data line driving circuit 140 to the n data lines 114. The PWM signals X1 to Xn may be alternatively generated by level-shifting output signals of the SR latches 1452.

Configuration of the Scanning Line Driving Circuit

The scanning line driving circuit 130 will now be described. The scanning line driving circuit 130 is constructed by a Y shift register and a level shifter circuit. The Y shift register is adapted to output signals y1 to ym in a predetermined sequence by sequentially shifting a transfer start pulse DY supplied at the beginning of the horizontal scanning period according to a clock signal CLY and its inverted clock signal CLYINV. The level shifter circuit is adapted to carry out a level shift on each output signal of the Y shift register only by a predetermined voltage. The output signals of the level shifter circuit are supplied as scanning signals Y1 to Ym to the m scanning lines.

Relationship of Various Waveforms

Voltage levels of the lamp wave signals LS, the PWM signals X1 to Xn, and the scanning signals Y1 to Ym set forth above will now be described. FIG. 4 shows an example of a relationship between a peripheral circuit of a pixel and voltage levels of various signals. In the drawing, VCOM denotes a potential of an opposing electrode, Vth1 denotes a threshold voltage of the TFT 116, and Vth2 denotes a threshold voltage of the TFT 117.

As shown in the diagram, the lamp wave signal LS linearly increases from a potential VLSmin to a potential VLSa in a horizontal scanning period Hodd of an odd ordinal number, whereas it linearly decreases from a potential VLSmax to a potential VLSb in a horizontal scanning period Heven of an even ordinal number. Setting has been made so that a difference between the potential VCOM and the potential VLSa of the opposing electrode is substantially equal to a difference between the potential VCOM and the potential VLSb, and a difference between the potential VCOM and the potential VLSmax of the opposing electrode is substantially equal to a difference between the potential VCOM and the potential VLSmin. The waveform of the lamp wave signal LS is inverted in polarity about the potential VCOM of the opposing electrode in the horizontal scanning period Hodd of an odd ordinal number and the horizontal scanning period Heven of an even ordinal number so as to prevent deterioration of a liquid crystal by applying an AC voltage to the liquid crystal.

Whether the inversion should be performed or not is usually decided depending on whether it is (1) polarity inversion in units of the scanning lines 112, (2) polarity inversion in units of the data lines 114, (3) polarity inversion in units of pixels, or (4) polarity inversion in units of screens. The inversion cycle is set to each horizontal scanning period, each vertical scanning period, or a dot clock cycle. In this embodiment, however, for the convenience of explanation, the descriptions will be given, taking the case of (1) polarity inversion in units of the scanning lines 112 as an example. This, however, should not be understood that the present invention is limited thereto.

An H-level potential YH of a scanning signal Y is set to be higher than an H-level potential XH of the PWM signal X by Vth1+α1. This setting is made to set the potential of the gate electrode to XH+Vth1+α1 when the potential of the source electrode becomes XH in the TFT 116 thereby to securely turn the TFT 1 16 ON. The value of α1 ranges from about 0V to about 5V.

The H-level potential XH of the PWM signal X is set to be higher than the maximum potential VLSmax of the lamp wave signal LS by Vth2+α2. When the TFT 116 turns ON, a gate electrode potential Q of the TFT 117 becomes equal to a source electrode potential of the TFT 116. A maximum value of the source electrode potential of the TFT 117 is obtained when the lamp wave signal LS is supplied to the signal supply line 113 and VLSmax is reached. The H-level potential XH of the PWM signal X is set to VLSmax+Vth2+α2 in order to securely turn the TFT 117 ON so as to apply the potential VLSmax to the pixel electrode 118. A value of α2 ranges from about 0V to about 5V.

In this example, over a period from time t1 to time t3, the scanning signal Y goes to the H-level, causing the TFT 116 to turn ON. Therefore, the PWM signal X is applied to the gate electrode of the TFT 117 during that period. And, over a period from t1 to time t2 during which the PWM signal is the H-level, the TFT 117 is turned ON, and the lamp wave signal LS is applied to the pixel electrode 118. This causes a voltage based on the value of the image data D to be applied to the liquid crystal via the pixel electrode 118. Then, when time t2 is reached, the PWM signal X switches from the H-level to the L-level, causing the TFT 117 to turn OFF. The liquid crystal equivalently has a capacitance component, so that it holds the voltage even when the TFT 117 turns OFF. This allows the pixel to perform gray scale display based on a gray scale value of the image data D.

An L-level potential YL of the scanning signal Y is set to be higher than an L-level potential XL of the PWM signal X by about Vth1. This setting is made in order to prevent the gate electrode of the TFT 117 from floating in a non-selection period of the pixel. The TFT 116 is OFF during a period Ta, but is on a boundary between an ON state and an OFF state in a period Tb. In other words, in the period Tb, the source electrode and the drain electrode are connected at a high impedance. Incidentally, a floating capacitor of a small value is equivalently connected to the gate electrode of the TFT 117. Hence, in the period Tb, the floating capacitor is charged with electric charges, so that the gate electrode potential Q of the TFT 117 maintains the potential XL in the non-selection period even when the TFT 116 has completely turned OFF in the period Ta. Accordingly, since the TFT 117 is completely OFF in the non-selection period, charges stored between the pixel electrode 118 and the opposing electrode will not leak through the TFT 117. This permits the quality of display images to be improved.

Operation of the First Embodiment

An operation of the liquid crystal device having the configuration discussed above will now be described. FIG. 5 is a timing chart for explaining the operation of the liquid crystal device. A pulse DY is supplied to the scanning line driving circuit 130 at the beginning of a vertical scanning period, sequentially shifted by the clock signal CLY and its inverted clock signal CLYINV, and scanning signals Y1, Y2, Y3, . . . , Ym are sequentially outputted to the scanning lines 112. This causes the plural scanning lines 112 to be line-sequentially selected downward one by one.

Meanwhile, the lamp wave signal LS shown in portion (a) of FIG. 5 is constantly supplied to the common signal line 111, and when the switches SW provided in association with the scanning lines 112 are turned ON, the lamp wave signals LS are supplied to the signal supply lines 113. As shown in portions (b) through (e) of FIG. 5, the scanning signals Y1, Y2, Y3, . . . , Ym do not overlap in the H-level period during which they are active, so that the switches SW do not simultaneously turn ON. Hence, the driving circuit of the lamp wave signals LS is connected only to a single signal supply line 113 selected by the switches SW. As a result, the load on the driving circuit will be a total of the parasitic capacitance of the common signal line 111 and the parasitic capacitance of a single signal supply line 113.

Incidentally, the parasitic capacitance occurs between the element substrate on which the common signal line 111 and the signal supply line 113 are formed and the opposing electrode of an opposing substrate that opposes via a liquid crystal, or the data lines 114. The common signal line 111 is formed in the peripheral portion of the element substrate wherein a part of a sealing member, which will be discussed later, (refer to FIG. 7 and FIG. 8) or the scanning line driving circuit 130 is also formed. Hence, the value for the parasitic capacitance of the common signal line 111 is smaller than the value of the parasitic capacitance of the signal supply line 113, and the load on the driving circuit is primarily depends on the parasitic capacitance of a single signal supply line 113.

In other words, according to the liquid crystal device of this embodiment, the load will be the parasitic capacitance that comes from the single signal supply line 113 extending in the X-direction rather than the parasitic capacitances of all the data lines 114 extending in the Y-direction, as in the prior art, allowing the load on the driving circuit to be dramatically reduced. As a result, the circuit configuration of the driving circuit can be simplified, and current consumption can be considerably reduced.

Focusing attention on a top left pixel shown in FIG. 1, a PWM signal X1 (refer to portion (i) of FIG. 5) is supplied to the source electrode of the TFT 116 of the pixel. The PWM signal X1 is generated as described below.

First, in the second latching section 144, line-sequential image data D1 is produced as shown in portion (g) of FIG. 5, and supplied to the comparator 1451 of the unit circuit R1 constituting the comparing section 145.

Then, the comparator 1451 compares the image data D1 with the count data CNT, and sets the logical level of the comparison signal CS to the H-level if they coincide. As mentioned above, the SR latch 1452 shifts the output signal to the H-level at a rising edge of the set signal SET, while it shifts the output signal to the L-level at a rising edge of the comparison signal CS. Therefore, if, for example, the set signal SET and the comparison signal CS are as shown in portions (f) and (h) of FIG. 5, then the PWM signal X1 will be as shown in portion (i) of FIG. 5. The H-level period of the PWM signal X1 will be based on image data D11, D12, D13, and so on. In other words, the PWM signal X1 is a pulse width modulation signal in which the pulse width has been modulated based on a gray scale value indicated by the image data D1.

In a period T shown in portion (k) of FIG. 5, both the scanning signal Y1 and the PWM signal X1 go to the H-level, so that the TFT 116 and the TFT 117 of the top left pixel shown in FIG. 1 simultaneously turn ON in the period T. This causes the lamp wave signal LS shown in portion (j) of FIG. 5 to be applied to the pixel electrode 118 via the TFT 1 17. Then, when the period T passes, the TFT 117 turns OFF. Therefore, the potential of the pixel electrode 118 is maintained at a fixed level after the period T elapses as shown in portion (l) of FIG. 5. Thus, a voltage V11 based on a gray scale value of image data D11 is applied to the liquid crystal, and gray scale display is performed.

As described above, in this embodiment, the lamp wave signal LS is supplied to only one signal supply line 113, allowing a marked reduction in current consumption in the liquid crystal device. In addition, when the scanning lines 112 are in the non-selection period, the TFT 116 is operated at the boundary between the ON state and the OFF state, so that the TFT 117 can be securely turned OFF, enabling the quality of display image to be improved.

Second Embodiment

In the first exemplary embodiment set forth above, the gate electrode of the TFT 116 is connected to the scanning line 112, the source electrode thereof is connected to the data line 114, and the drain electrode thereof is connected to the gate electrode of the TFT 117, and the source electrode of the TFT 117 is connected to the signal supply line 113, and the drain electrode thereof is connected to the pixel electrode 118. Furthermore, the liquid crystal device according to the first embodiment is adapted to supply the lamp wave signals LS to the signal supply lines 113 via the switches SW, thereby reducing the load on the driving circuit of the lamp wave signals LS. The present invention is able to reduce current consumption in a driving circuit by reducing the load in another configuration in addition to the above. Accordingly, a second exemplary embodiment different from the first embodiment will now be described.

FIG. 6 is a block diagram of a liquid crystal device according to the second embodiment. The liquid crystal device according to the second embodiment is configured in the same manner as that of the first embodiment shown in FIG. 1, except for a configuration of the TFTs for each pixel. In FIG. 6, at each intersection of a scanning line 112 and a data line 114, switches TFT 116*a* and TFT 117*a* serving as switches for controlling the pixels are provided. A gate electrode of the TFT 116*a* is connected to the data line 114, a source electrode of the TFT 116*a* is connected to a signal supply line 113, and a drain electrode of the TFT 116*a* is connected to a source electrode of the TFT 117*a*. A gate electrode of the TFT 117*a* is connected to the scanning line 112, and a drain electrode thereof is connected to a pixel electrode 118. Therefore, when the TFT 116*a* and the TFT 117*a* simultaneously turn ON, a voltage of the signal supply line 113 is applied to the pixel electrode 118.

In this example, since the gate electrodes of the TFT 116*a* and the TFT 117*a* are connected to the data line 114 and the scanning line 112, respectively, there is no need to take any measures for the logical level of a PWM signal X and a scanning signal Y in order to prevent the TFT 117*a* from floating as in the case of the TFT 117 of the first embodiment.

Incidentally, in general, the gate electrode of a TFT is fabricated by forming an extremely thin oxide insulating film on a semiconductor layer, then providing the electrode using aluminum or the like on the oxide insulating film, in the same manner as that for an electric field effect transistor having a CMOS structure. On the other hand, the source electrode or the drain electrode is directly connected to the semiconductor layer. Therefore, the gate electrode is capacitively coupled to the semiconductor layer via the oxide insulating film. Hence, it can be said that a gate capacitance value is larger than a source capacitance value.

In the liquid crystal device according to the second embodiment, the gate electrode of the TFT 116*a* is connected to the data line 114. Therefore, the liquid crystal device according to the first embodiment may be advantageous over the liquid crystal device according to the second embodiment in that the parasitic capacitance value of the data line 114 is smaller than that in the liquid crystal device according to the second embodiment.

However, in the liquid crystal device according to the second embodiment also, the switches SW provided in association with the scanning lines 112 do not simultaneously turn ON, so that the driving circuit of the lamp wave signals LS is connected to only one signal supply line 113 selected by the switches SW. Thus, the load on the driving circuit is determined primarily by the parasitic capacitance of a single signal supply line 113.

As a result, according to the liquid crystal device of the second embodiment, as in the case of the liquid crystal device of the first embodiment, the parasitic capacitance of a single signal supply line 113 extending in an X-direction will be the load, so that the load on the driving circuit can be dramatically reduced, the circuit configuration of the driving circuit can be simplified, and current consumption can be markedly reduced.

Configuration Example of Liquid Crystal Panel

A general configuration of the liquid crystal panel 100 having the data line driving circuit 140 according to the embodiments described above will be explained with reference to FIG. 7 and FIG. 8. FIG. 7 is a perspective view showing the configuration of the liquid crystal panel 100, and FIG. 8 is a sectional view taken at the line A-A' in FIG. 7.

As shown in the drawings, the liquid crystal panel 100 has a structure in which an element substrate 101 on which pixel electrodes 118, etc. are formed and a transparent opposing substrate 102 on which a common electrode 108, etc. are formed. The element substrate 101 is composed of glass, semiconductor, quartz, or the like, and the opposing substrate 102 is composed of glass or the like. The element substrate 101 and the opposing substrate 102 are attached to each other by a sealing member 104 in which spacers 103 are mixed in, so that their surfaces on which the electrodes are formed facing each other with a fixed gap maintained therebetween. A liquid crystal 105 as an electro-optical material is sealed in the gap. The sealing member 104 is formed along a substrate periphery of the opposing substrate 102, a part thereof being opened for injecting the liquid crystal 105. Hence, after injecting the liquid crystal 105, the opening is sealed by a sealing member 106.

In an outer side of the sealing member 104 that is an opposing surface of the element substrate 101, the foregoing data line driving circuit 140 and a sampling circuit 150 are formed to drive the data lines 114 extending in the Y-direction. Furthermore, on this one side, a plurality of external circuit connection terminals 107 are formed to receive various signals from the control circuit 200. The two sides adjoining to the one side have two scanning line driving circuits 130 formed thereon to drive the scanning lines 112, which extend in the X-direction, from both sides. If delays of scanning signals supplied to the scanning lines 112 lead to no problem, then the configuration may include only one scanning line driving circuit 130 on one side.

The common electrode 108 of the opposing substrate 102 is electrically conducted with the element substrate 101 through an electrically conducting member provided at least one of four comers of a portion where it is attached to the element substrate 101. Furthermore, according to the application of the liquid crystal panel 100, the opposing substrate 102 is provided, in addition to the foregoing components, firstly with, for example, color filters arranged in a stripe, mosaic, or triangular pattern, etc., secondly with, for example, a light-shielding film composed of a metal material, such as chromium, nickel, etc. or a resin black containing carbon, titanium, or the like dispersed in a photoresist, and thirdly with a backlight for applying light to the liquid crystal panel 100. For an application of colored light modulation, no color filter is provided, but a light-shielding film is provided on the Opposing Substrate 102.

In addition, the opposing surfaces of the element substrate 101 and the opposing substrate 102 are provided mainly with alignment layers (not shown) that have been subjected to rubbing in predetermined directions, and polarizers (not shown) adapted for the alignment directions are provided at their rear surface side. However, using a polymer-dispersion type liquid crystal with micro-particles dispersed in macromolecules as the liquid crystal 105 obviates the need for the foregoing alignment layers and polarizers. As a result, utilization efficiency of light is increased, leading to an advantage in achieving higher luminance and lower power consumption.

In an alternative configuration, instead of forming a part or all of the peripheral circuits, including the scanning line driving circuit 130 and the data line driving circuit 140, on the element substrate 101, the TAB (Tape Automated Bonding) technique, for example, may be employed to make electrical and mechanical connection of a driving IC chip mounted on a film via an anisotropic electrically conductive film provided at a predetermined position of the element substrate 101, or the COG (Chip On Glass) technique may be used to electrically and mechanically connect a driving IC chip itself via an anisotropic electrically conductive film at a predetermined position of the element substrate 101.

Configuration, etc. of the Element Substrate

In the exemplary embodiments, it has been described that the element substrate 101 of the liquid crystal panel 100 is constructed by a transparent insulating substrate made of glass or the like, a silicon thin film is formed on the substrate, and the pixel switching elements (TFT 116), and the elements of the scanning line driving circuit 130 and the data line driving circuit 140 are configured by the TFTs composed of sources, drains, and channels formed on the thin film; the present invention, however, is not limited thereto.

For example, the pixel switching elements and the elements of the driving circuits 130 and 140 may be constituted by forming the element substrate 101 by a semiconductor substrate, and by using an insulated-gate type field effect transistor where a source, a drain, and a channel are formed on the surface of the foregoing semiconductor substrate. When the element substrate 101 is formed by the semiconductor substrate, the completed device cannot be used as a transmissive electro-optical device; hence, the pixel electrodes 118 will be formed by aluminum or the like to use the completed device as a reflective type. Alternatively, the element substrate 101 may be used simply as a transparent substrate, and the pixel electrodes 118 may be of a reflective type.

Furthermore, in addition to a liquid crystal, an electroluminescent element or the like may be used as the electro-optical material, allowing an application to a display device performing display by the electro-optical effect of the electroluminescent element or the like. In other words, the present invention can be applied to any electro-optical devices having configurations similar to those of the liquid crystal devices described above.

Lamp Signal and PWM Signal

In the embodiments set forth above, the lamp wave signals LS that linearly increase or decrease as illustrated in FIG. 4 are used as the reference signals thereby to apply voltages based on the pulse widths of the PWM signals to the pixel electrodes 118. The present invention, however, is characterized by supplying the reference signals via the switches SW; therefore, the reference signals are not limited to the lamp wave signals LS. For instance, the reference signals may be based on a gamma correction characteristic of a liquid crystal so as to perform gamma corrections. In this case, the waveforms of the reference signals may be nonlinearly and monotoneously increased or decreased.

Furthermore, in the exemplary embodiments described above, the pulse widths of the PWM signals corresponding to LSBs of image data remain unchanged independently of the magnitude of image data values. The present invention, however, is not limited thereto; the pulse widths may be changed according to gamma correction characteristics. For example, the pulse width may be set such that, if an image data value is small, then the pulse width of a PWM signal corresponding to the LSB of the image data is increased, the pulse width is decreased as the image data value increases, reaches a minimum value when the image data value takes a central value, and gradually increases beyond the central value.

Electronic Device

Examples where the liquid crystal devices described above are applied to a variety of electronic equipment will now be explained.

EXAMPLE 1

Projector

First, a projector in which the liquid crystal panel 100 is used as a light valve will be described. FIG. 9 is a top plan view showing a configuration of the projector. As shown in the drawing, a lamp unit 1102 composed of a white light source, such as a halogen lamp, is provided inside the projector 1100. A projected light emitted from the lamp unit 1102 is separated into three primary colors, RGB, through three mirrors 1106 and two dichroic mirrors 1108 disposed therein, and led to liquid crystal panels 100R, 100B, and 100G serving as light valves for the respective primary colors. The light of color B has a longer optical path than the other colors R and G, so that it is led via a relay lens system 1121 composed of an incident lens 1122, a relay lens 1123, and an outgoing lens 1124 in order to restrain a loss.

The liquid crystal panels 100R, 100B, and 100G have configurations equivalent to the configuration of the liquid crystal panel 100 described above, and are respectively driven by R, G, and B primary color signals supplied from an image signal processing circuit (not shown). The light rays that have been modulated by these liquid crystal panels enter a dichroic prism 1112 from three directions. In the dichroic prism 1112, the light rays of color R and color B are refracted at 90 degrees, while the light ray of color G advances straight. Accordingly, as the images of the respective colors are synthesized, a color image is projected onto a screen 1120 via a projection lens 1114.

Focusing attention on displayed images by the liquid crystal panels 100R, 100B, and 100G, the display image by the liquid crystal panel 100G must be laterally inverted in relation to the displayed images by the liquid crystal panels 100R and 100B. Hence, the horizontal scanning direction of the liquid crystal panel 100G and the horizontal scanning direction of the liquid crystal panels 100R and 100B are opposite from each other. The light rays corresponding to the respective primary colors R, G, and B are incident upon the liquid crystal panels 100R, 100B, and 100G through the dichroic mirrors 1108; hence, there is no need to provide any color filters.

EXAMPLE 2

Mobile Computer

An example wherein the liquid crystal panel has been applied to a mobile personal computer will now be described. FIG. 10 is a perspective view showing a configuration of the personal computer. In the drawing, a computer 1200 is constituted by a main unit 1204 equipped with a keyboard 1202, and a liquid crystal display unit 1206. The liquid crystal display unit 1206 is formed by adding a backlight to the rear surface of the liquid crystal panel 100.

EXAMPLE 3

Portable Telephone

Another example wherein the liquid crystal panel has been applied to a portable telephone will now be described. FIG. 11 is a perspective view showing a configuration of the portable telephone. In the drawing, a portable telephone 1300 is equipped with a plurality of operating buttons 1302, an ear piece 1304, a mouth piece 1306, and the liquid crystal panel 100. The liquid crystal panel 100 can also be provided with a backlight at the rear surface thereof when necessary.

The electronic equipment may further include a liquid crystal television, a view-finder or monitor direct-viewing type video tape recorder, a car navigation device, a pager, an electronic pocketbook, an electronic calculator, a word processor, a workstation, a television telephone, a POS terminal, and an apparatus with a touch panel, in addition to those explained with reference to FIG. 9 through FIG. 11. It is obvious that the liquid crystal panels of the embodiments and also electro-optical devices can be applied to all these diverse types of electronic equipment.

As described above, according to various exemplary embodiments of the present invention, a reference signal is supplied to a single signal supply line. Therefore, the load on the driving circuit for driving the reference signal will be the parasitic capacitance from the single signal supply line, making it possible to markedly reduce the load. Furthermore, the circuit configuration of the driving circuit can be simplified, and the current consumption in the driving circuit can be considerably reduced.

What is claimed is:

1. A driving method of an electro-optical device provided with a plurality of data lines, a plurality of scanning lines, pixel electrodes corresponding to intersections of said scanning lines and said data lines, and a plurality of signal supply lines corresponding to the scanning lines, the method comprising the steps of:

supplying scanning signals respectively for sequentially selecting said scanning lines;

sequentially supplying reference signals to the signal supply lines synchronously when said scanning signals become active;

supplying pulse width modulation signals respectively that are active only during a period corresponding to a gray scale value indicated by image data to each of the data lines; and capturing reference signals from the signal supply lines corresponding to pixels, and applying the captured reference signals to said pixel electrodes during a period in which the scanning lines and the data lines corresponding to the pixels simultaneously become active at said pixels corresponding to intersections of said scanning lines and said data lines, while holding voltages of the pixel electrodes during a period in which either the scanning lines or the data lines corresponding to said pixels become inactive.

2. An electro-optical device composed of a pair of substrates with an electro-optical material sandwiched therebetween, comprising on one of the substrates:

a plurality of data lines;

a plurality of scanning lines;

a plurality of pixel electrodes provided in association with intersections of the scanning lines and the data lines;

a plurality of signal supply lines corresponding to the scanning lines;

a signal supply circuit that selects one signal supply line of said signal supply lines that has its corresponding scanning line in an active state, and that supplies a reference signal to the selected signal supply line; and voltage holding circuits that are provided respectively in association with the intersections of said scanning lines and said data lines, and that capture said reference signals from the signal supply lines corresponding to pixels, and that apply the captured reference signals to said pixel electrodes during a period in which the scanning lines and the data lines corresponding to the pixels simultaneously become active, while holding voltages of said pixel electrodes during a period in which one of corresponding scanning lines or data lines become inactive.

3. The electro-optical device according to claim 2, said signal supply circuit comprising:

a switching element provided for each of said signal supply lines, one end of said each signal supply line being connected to one terminal of the switching element, and turning ON/OFF of the switching element being controlled by a signal of a corresponding scanning line; and a common signal line which is connected to another terminal of each switching element and to which said reference signal is supplied.

4. The electro-optical device according to claim 2, each of said voltage holding circuits comprising:

a first transistor element provided for each of the intersections of said scanning lines and said data lines, the first transistor element having a gate electrode connected to one of said scanning lines, a source electrode connected to one of said data lines, and a drain electrode; and a second transistor element provided for each of the intersections of said scanning lines and said data lines, the second transistor element having a gate electrode connected to the drain electrode of said first transistor element, a source electrode connected to said signal supply line, and a drain electrode connected to said pixel electrode.

5. A driving circuit of an electro-optical device that drives the electro-optical device according to claim 4, comprising:

a reference signal generating circuit that generates said reference signals;

a converting circuit that converts image data into line-sequential data;

a pulse width modulating circuit that generates pulse width modulation signals in which pulse widths have been modulated based on data values of said line-sequential data, and that outputs the pulse width modulation signals to said data lines; and a scanning line driving circuit that generates scanning signals for sequentially setting said scanning lines active, and that outputs the scanning signals to said scanning lines, a low-level potential of said scanning signals being set to be higher than a low-level potential of said pulse width modulation signals by about a threshold value voltage of said second transistor element.

6. The driving circuit of an electro-optical device according to claim 5, the reference signals being lamp wave signals.

7. The driving circuit of an electro-optical device according to claim 5, said pulse width modulating circuit generating said pulse width modulation signals so that a high-level potential of said pulse width modulation signals is higher than a maximum potential of said reference signals by at least the threshold value voltage of said second transistor element; and said scanning line driving circuit generating said scanning signals so that a high-level potential of said scanning signals is higher than the high-level potential of said pulse width modulation signals by at least a threshold value voltage of said first transistor element.

8. The driving circuit of an electro-optical device according to claim 7, the reference signals being lamp wave signals.

9. The electro-optical device according to claim 2, each of said voltage holding circuit comprising:

a first transistor element provided for each of the intersections of said scanning lines and said data lines, the first transistor element having a gate electrode connected to one of said data lines, a source electrode connected to one of said signal supply lines and a drain electrode; and a second transistor element provided for each of the intersections of said scanning lines and said data lines, the second transistor element having a source electrode connected to the drain electrode of side first transistor element, a gate electrode connected to said one scanning line, and a drain electrode connected to said pixel electrode.

10. A driving circuit of an electro-optical device that drives the electro-optical device according to claim 2, comprising:

a reference signal generating circuit that generates said reference signals;

a converting circuit that converts image data into line-sequential data;

a pulse width modulating circuit that generates pulse width modulation signals in which pulse widths have been modulated based on data values of said line-sequential data, and that outputs the pulse width modulation signals to said data lines; and a scanning line driving circuit that generates scanning signals for sequentially setting said scanning lines active, and that outputs the scanning signals to said scanning lines.

11. The driving circuit of an electro-optical device according to claim 10, the reference signals being lamp wave signals.

12. An electro-optical device according to claim 2, further comprising a driving circuit formed on one of the pair of said substrates, the driving circuit comprising:

a reference signal generating circuit that generates said reference signals;

a converting circuit that converts image data into line-sequential data;

a pulse width modulating circuit that generates pulse width modulation signals in which pulse widths have been modulated base on data values of said line-sequential data, and that outputs the pulse width modulation signals to said data lines; and a scanning line driving circuit that generates scanning signals for sequentially setting said scanning lines active, and that outputs the scanning signals to said scanning lines.

13. An electronic apparatus comprising the electro-optical device according to claim 12.

* * * * *